US007357627B2

(12) United States Patent
Sato

(10) Patent No.: US 7,357,627 B2
(45) Date of Patent: Apr. 15, 2008

(54) SCROLL FLUID MACHINE

(75) Inventor: Kazuaki Sato, Yokohama (JP)

(73) Assignee: Anest Iwata Corporation (JP)

( * ) Notice: Subject to any disclaimer, the term of this patent is extended or adjusted under 35 U.S.C. 154(b) by 0 days.

(21) Appl. No.: 11/319,120

(22) Filed: Dec. 27, 2005

(65) Prior Publication Data

US 2006/0140806 A1 Jun. 29, 2006

(30) Foreign Application Priority Data

Dec. 27, 2004 (JP) ..... 2004-377651

(51) Int. Cl.
*F04C 18/04* (2006.01)

(52) U.S. Cl. ..... 418/55.3; 418/55.1; 418/55.5; 418/57; 464/102; 464/103

(58) Field of Classification Search ..... 418/55.1, 418/55.3, 55.5, 57; 464/102, 103
See application file for complete search history.

(56) References Cited

U.S. PATENT DOCUMENTS 5,391,065 A * 2/1995 Wolverton et al. ..... 418/55.3
5,752,816 A * 5/1998 Shaffer ..... 418/55.2
5,759,020 A * 6/1998 Shaffer ..... 418/55.3
6,290,477 B1 * 9/2001 Gigon ..... 418/55.2
2003/0223898 A1 * 12/2003 Fujioka et al. ..... 418/55.3

FOREIGN PATENT DOCUMENTS

JP 2599626 11/1990
JP 06213174 A * 8/1994
JP 11-247770 9/1999
JP 2003-201977 7/2003

* cited by examiner

*Primary Examiner*—Thomas Denion
*Assistant Examiner*—Mary A Davis
(74) *Attorney, Agent, or Firm*—Ostrolenk, Faber, Gerb & Soffen, LLP

(57) ABSTRACT

In a scroll fluid machine, a stationary scroll fixed to a housing engages with an orbiting scroll to form a sealed chamber between the orbiting and stationary scrolls. Fluid in the sealed chamber is compressed or decompressed with revolution of the orbiting scroll with respect to the stationary scroll. A plurality of self-rotation preventing devices are provided on the orbiting scroll to prevent the orbiting scroll from rotating on its own axis. The self-rotation preventing device comprises an eccentric tube connected to a main shaft fitting in the housing, and an eccentric shaft fitted in a bearing plate. The eccentric tube is eccentrically revolved with respect to the main shaft thereby allowing engagement of the orbiting scroll with the stationary scroll to be adjusted.

8 Claims, 5 Drawing Sheets

SCROLL FLUID MACHINE

CROSS REFERENCE TO RELATED APPLICATIONS

The present application claims priority of Japanese Patent Application No. 2004-377651 filed on Dec. 27, 2004, incorporated herein by reference.

BACKGROUND OF THE INVENTION

The present invention relates to a scroll fluid machine such as a scroll compressor, a scroll vacuum pump, a scroll expander or a scroll blower.

In such a scroll fluid machine, an orbiting scroll is rotatably secured to an eccentric axial portion of a driving shaft via a bearing. On an orbiting end plate of the orbiting scroll, an orbiting wrap engages with a stationary wrap on a stationary end plate of a stationary scroll to form a sealed chamber between the orbiting and stationary wraps. There are provided a plurality of self-rotation preventing devices for preventing the orbiting scroll from rotating on its own axis.

By revolving the ordinary scroll with the eccentric axial portion of the driving shaft, fluid sucked from the outer circumference into the sealed chamber is compressed towards its center or fluid sucked from the center is decompressed towards the outer circumference.

A known scroll compressor is shown in FIG. 5 and will be described below. The present invention can be applied to a scroll expander or other scroll fluid machines as well. In FIG. 5, the left and right sides are deemed as the front and rear respectively.

A stationary scroll 1 in the front or left side of FIG. 5 comprises a circular stationary end plate 8 which has an intake port 2 on the outer circumference and a discharge port 3 at its center. The stationary end plate 8 has a spiral stationary wrap 5 on the rear surface and a plurality of corrugated equal-height cooling fins 10 on the rear surface.

An orbiting scroll 7 is provided behind the stationary scroll 1 and comprises an orbiting end plate 8 which has a spiral orbiting wrap 9 on the front surface which faces the stationary scroll 1, and a plurality of corrugated equal-height cooling fins 10 on the rear surface.

A bearing plate 11 is fixed to the rear surface of the orbiting scroll 7. A tubular boss 15 projects at the center of the rear surface of the bearing plate 11 and rotatably supports an eccentric axial portion 13 of a driving shaft 12 via a roller bearing 14. A pin-cranks-type self-rotation preventing devices 16 is provided at three points on the outer circumference of the orbiting scroll 7 so that the orbiting scroll 7 may eccentrically revolve around the driving shaft 12 in a housing 17.

In the self-rotation preventing device 16, an eccentric shaft 20 of a main shaft 19 rotatably secured to the housing 17 is rotatably secured via a ball bearing 22 in an eccentric boss 21 at three points on the outer circumference of the rear surface of the bearing plate 11.

A cover plate 23 is fixed on the front surface of the stationary scroll 1 with a screw 24. The orbiting scroll 7 is fixed to the bearing plate with a screw 25.

A rear plate 26 of the stationary scroll 1 is fixed to the front surface of the housing 17 with a bolt 27 and a nut 28. Engagement grooves 5*a* and 9*a* are formed on the tip ends of the stationary wrap 5 and the orbiting wrap 9 respectively, and sealing members "S" that fit in the engagement grooves 5*a* and 9*a* are in sliding contact with the orbiting end plate 8 of the orbiting scroll 7 and the stationary end plate 4 of the stationary scroll 1 respectively.

Long-time use of such a scroll fluid machine causes wear of the sealing member "S" on the tip end of the stationary wrap 5 or orbiting wrap 9 and clearance of the bearings, thereby making contact pressure to the opposite end plate 8 or 4 unsuitable. Unevenness in temperature and pressure of each part makes the stationary end plate 4 or orbiting end plate 8 tilted with respect to the axis of the driving shaft 12 or involved in surging.

Its performance decreases and each part generates heat or noise. So it is necessary to correct engagement degree or clearance between the stationary wrap 5 and the orbiting wrap 6 or inclination with respect to the surface perpendicular to the axis of the driving shaft 12.

To adjust axial clearance between the stationary scroll and the orbiting scroll in the scroll fluid machine or to correct squareness with respect to the driving shaft, there are two methods below:

A) To insert a shim or other suitable spacer into a contact surface between the stationary and orbiting scrolls; and B) To adjust axial engagement depth of the main shaft of the crankshaft 20 in the self-rotation preventing device with respect to the housing.

According to the method "A", without special technique, axial clearance can be adjusted easily at low cost. It is necessary to insert a suitable-thickness shim between the stationary and orbiting scrolls and to assemble it after axial clearance is measured in the assembling and disassembled, which is troublesome. It is impossible to make sure of whether the selected shim could have a suitable thickness, without assembling again. A desired axial clearance cannot be obtained by a shim.

The method "B" enables axial clearance to be adjusted while it is measured without disassembling the stationary and orbiting scrolls, but it is necessary to move the self-rotation preventing device itself axially with a special tool. It requires high skill and a lot of works to clamp an outer ring of the bearing with a plurality of bolts to keep good balance.

Furthermore, to return the fitted bearing to an original position, it is necessary to pull out the bearing with a special tool and to pressingly fit it again, which requires power and is troublesome.

The detached bearing is usually deformed to make it impossible to be used again.

SUMMARY OF THE INVENTION

In view of the disadvantages, it is an object of the invention to provide a scroll fluid machine to simplify the structure of a plurality of self-rotation preventing devices and to adjust axial clearance between stationary and orbiting scrolls or to correct squareness of them with respect to the axis easily.

BRIEF DESCRIPTION OF THE DRAWINGS

The features and advantages of the invention will become more apparent from the following description with respect to the embodiments as shown in the drawings wherein.

DETAILED DESCRIPTION OF PREFERRED EMBODIMENTS

Figure 1:
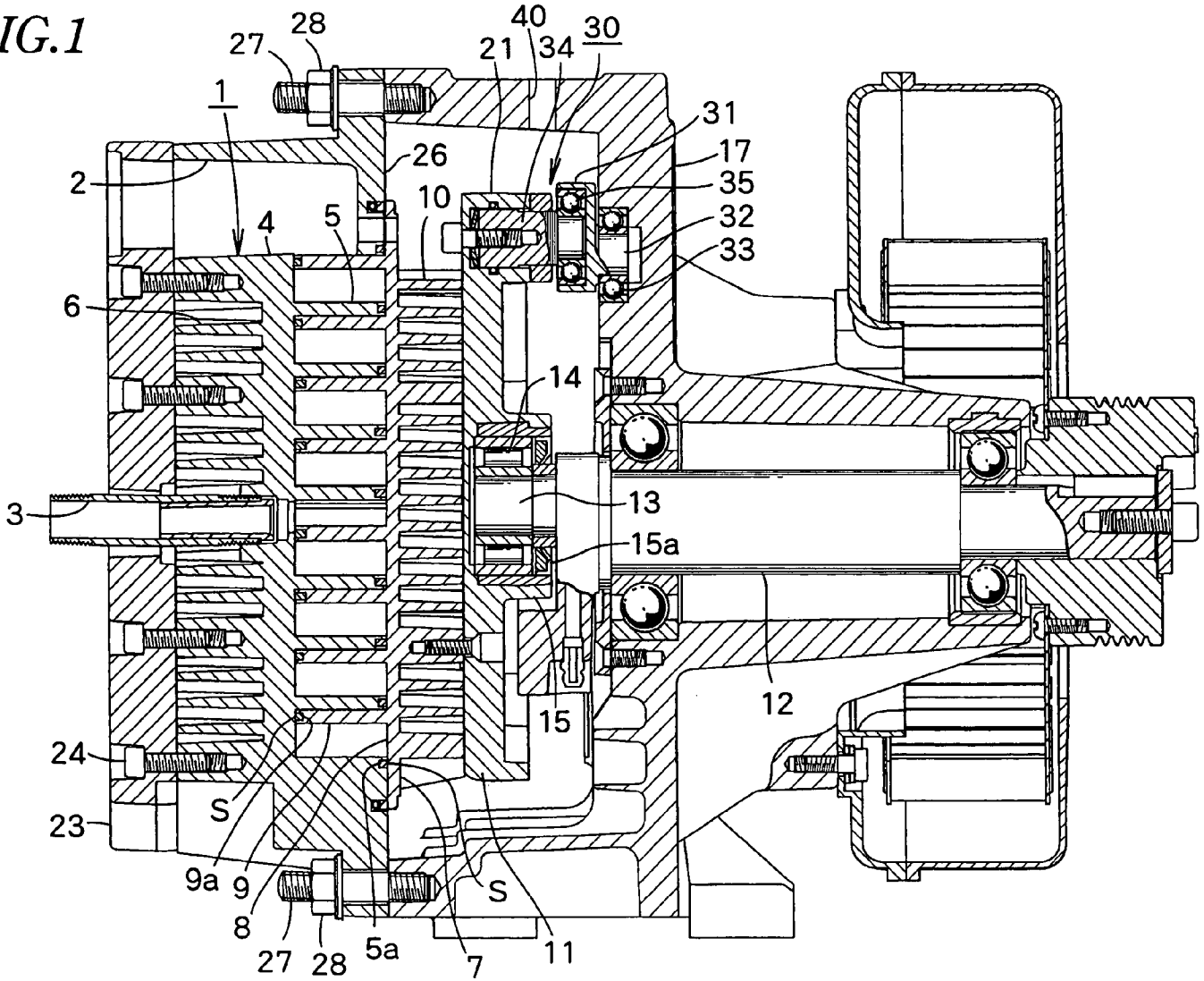
FIG. 1 is a vertical sectional front view showing one embodiment of the present invention.
Figure 5:
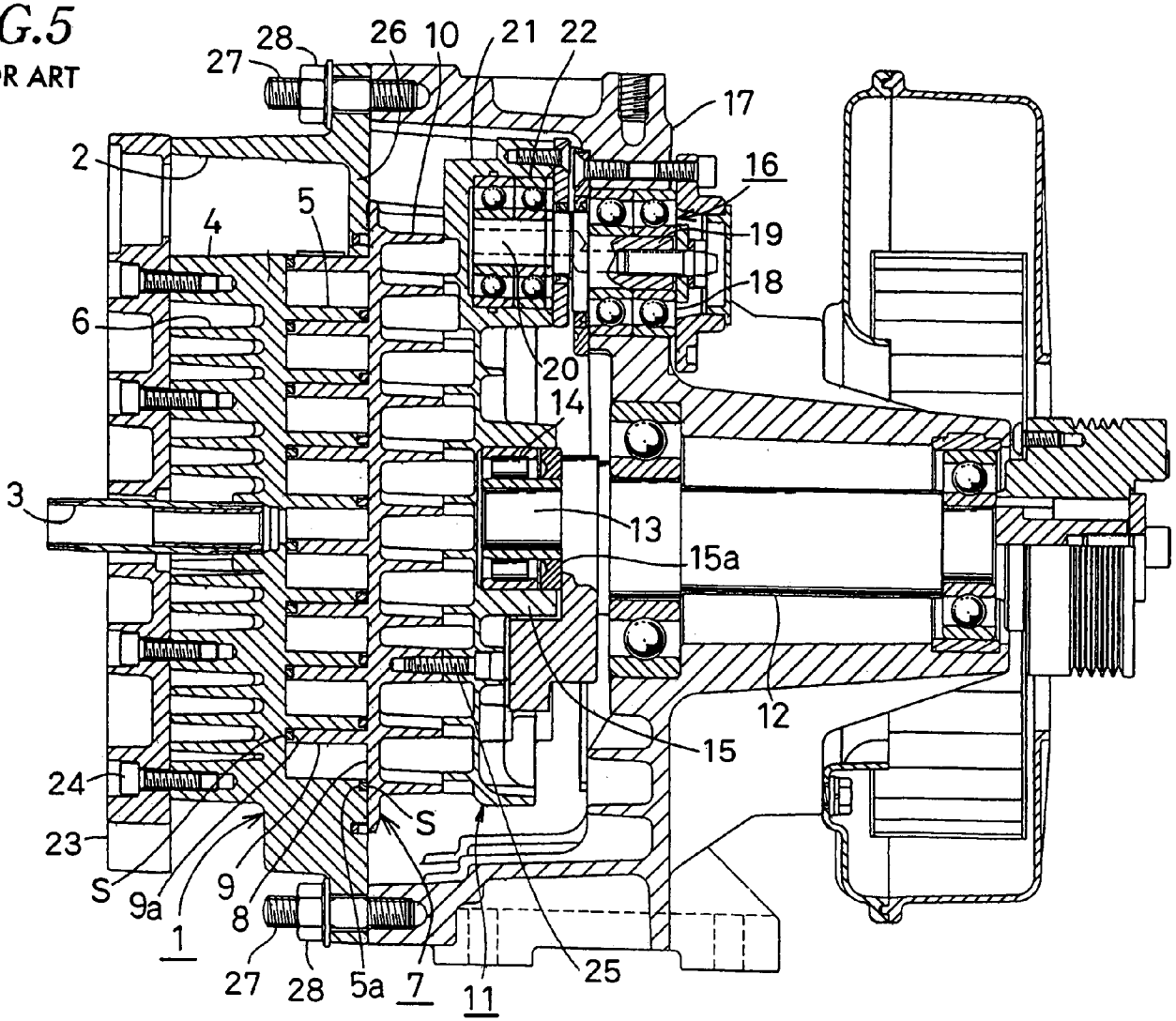
FIG.5 PRIOR ART
FIG. 5 is a vertical sectional front view showing a known scroll fluid machine.

FIG. 1 shows an embodiment of the present invention and is similar to FIG. 5 except of a self-rotation preventing device 30 which is different from the device 16 in FIG. 5.

The same numerals are assigned to the same members as those in FIG. 5 and its description is omitted. Only the self-rotation preventing device 34 will be described with respect to FIG. 2.

A main shaft 32 connected to an eccentric tube 31 is rotatably secured via a ball bearing 33 to make it impossible for the shaft 32 to move axially.

An eccentric shaft 34 or crank shaft engages with an eccentric boss 21 which is equally spaced on the outer circumference of a bearing plate 11 fixed to the rear surface of an orbiting scroll 7. The eccentric shaft 34 is rotatably mounted in the eccentric tube 31 via a ball bearing 35. Between the outer end face of the eccentric shaft 34 and a bottom wall 21*a* of the eccentric boss 21, a small space or gap is formed. In the space, a belleville spring or other resilient member is put and a clamping bolt 37 through the bottom wall 21*a* fits into the end face of the eccentric shaft 34.

A male thread is formed on the outer circumference of the crankshaft 34 and a nut 38 which engages on the male thread is tightened to contact the outer end face of the eccentric boss 21 thereby preventing the eccentric shaft 34 from being removed.

Holes 39,40 are formed through the rear plate 26 and the housing 17 to allow the clamping bolt 37 and the nut 38 to turn. The nut 38 is loosened with a spanner which is inserted through the hole 40. Then, the clamping bolt 37 is operated with a hex stock key inserted through the hole 39 to allow the orbiting scroll 7 to move with the bearing plate 11 thereby adjusting engagement degree of the orbiting scroll 7 with respect to the stationary scroll 1.

Figure 2:
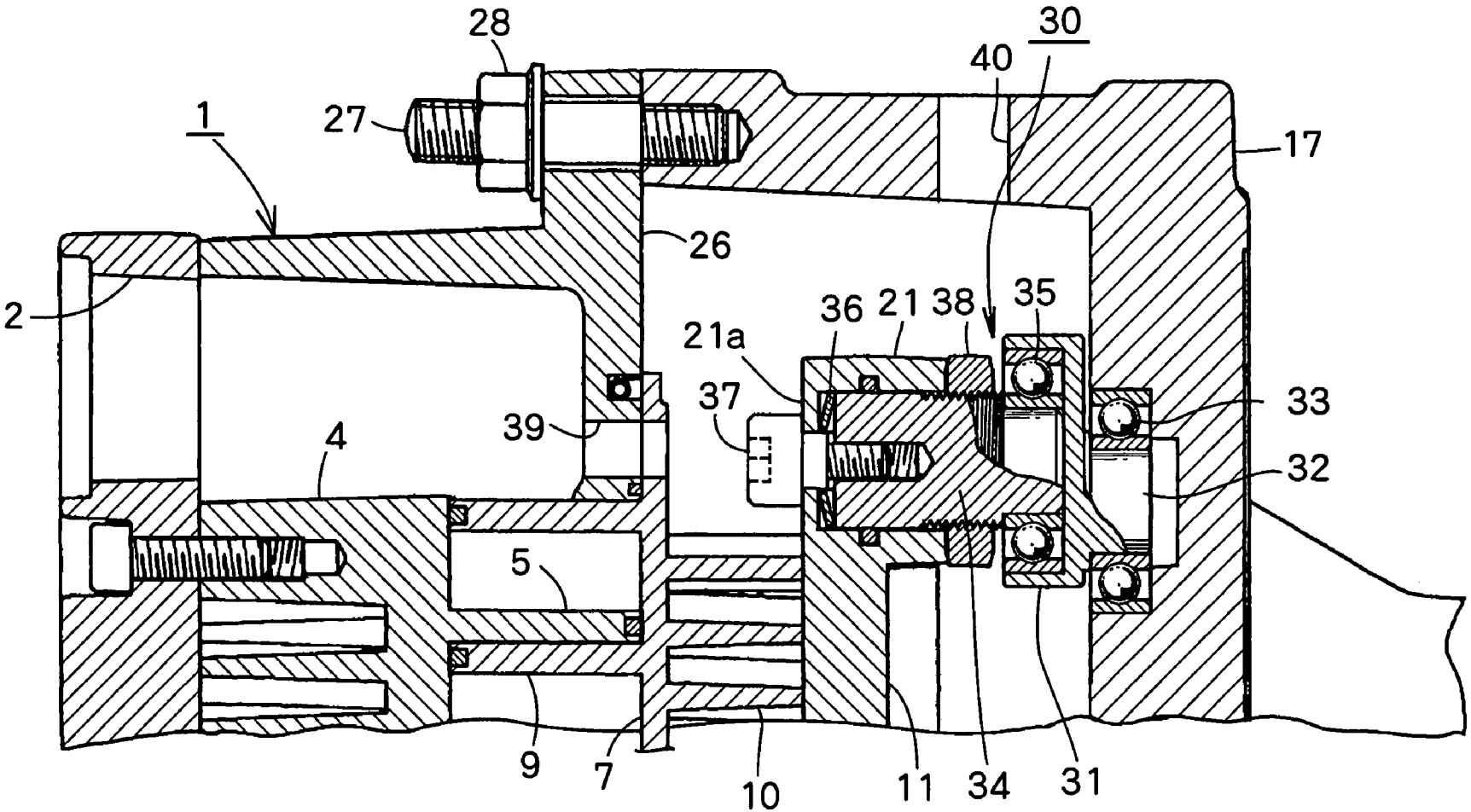
FIG. 2 is an enlarged view of a main part in FIG. 1.
Figure 3:
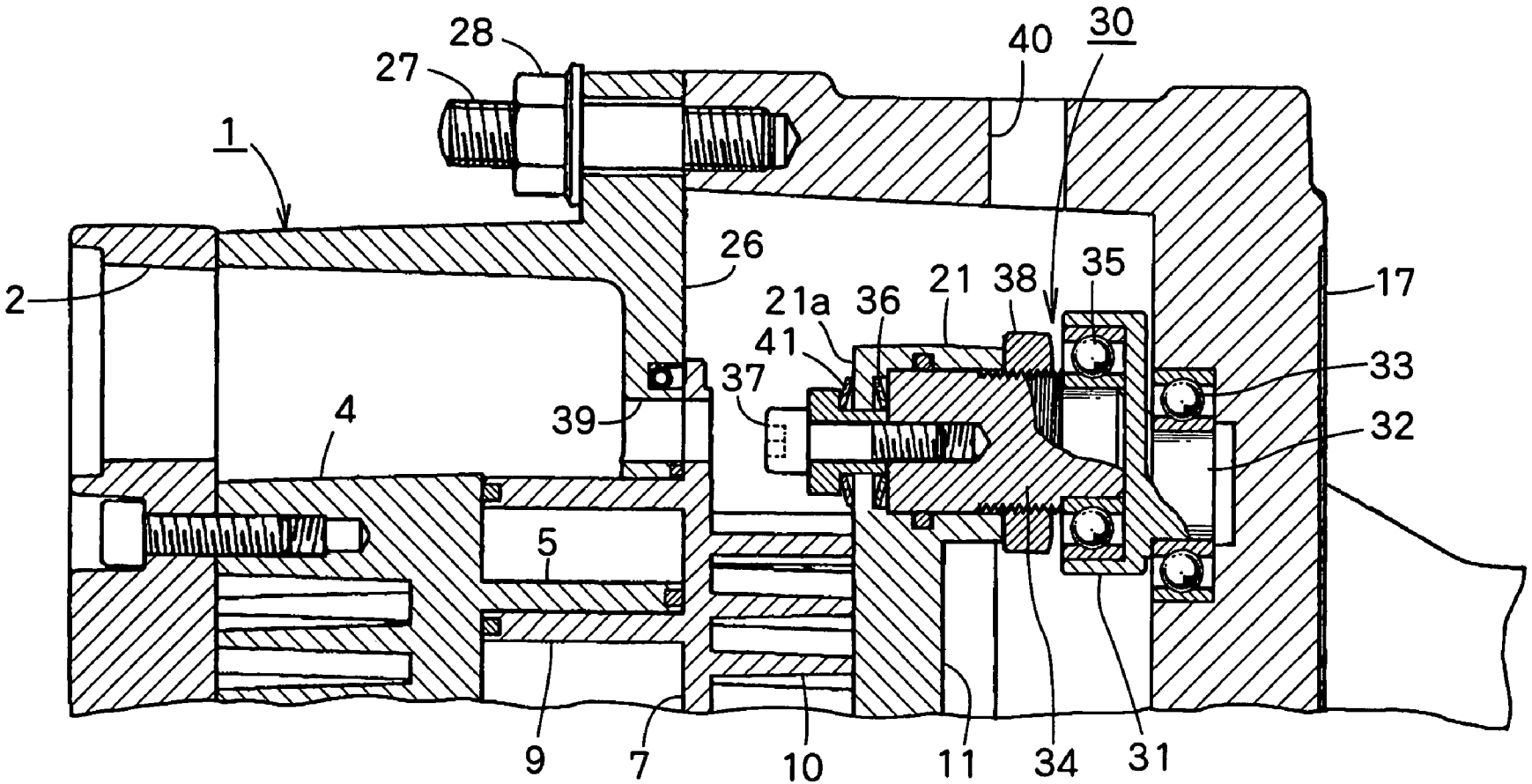
FIG. 3 is a view which shows another embodiment of the present invention and similar to FIG. 2.

If inclination of the orbiting scroll 7 makes squareness to the driving shaft out of order, such malfunction will be corrected by adjusting engagement of the eccentric boss 21 in the eccentric shaft 34 in any one or all of the self-rotation preventing devices 16, FIG. 3 is another embodiment similar to FIG. 2. In FIG. 3, there is a gap between the head of a clamping bolt 37 and a bottom wall 21*a* of an eccentric boss 21 as well as a gap between the inner end face of an eccentric shaft 34 and the bottom wall 21*a* of an eccentric boss 21. Beleville springs 36,41 or other resilient material are put in the gaps respectively. The others are not different from those in FIG. 2.

Figure 4:
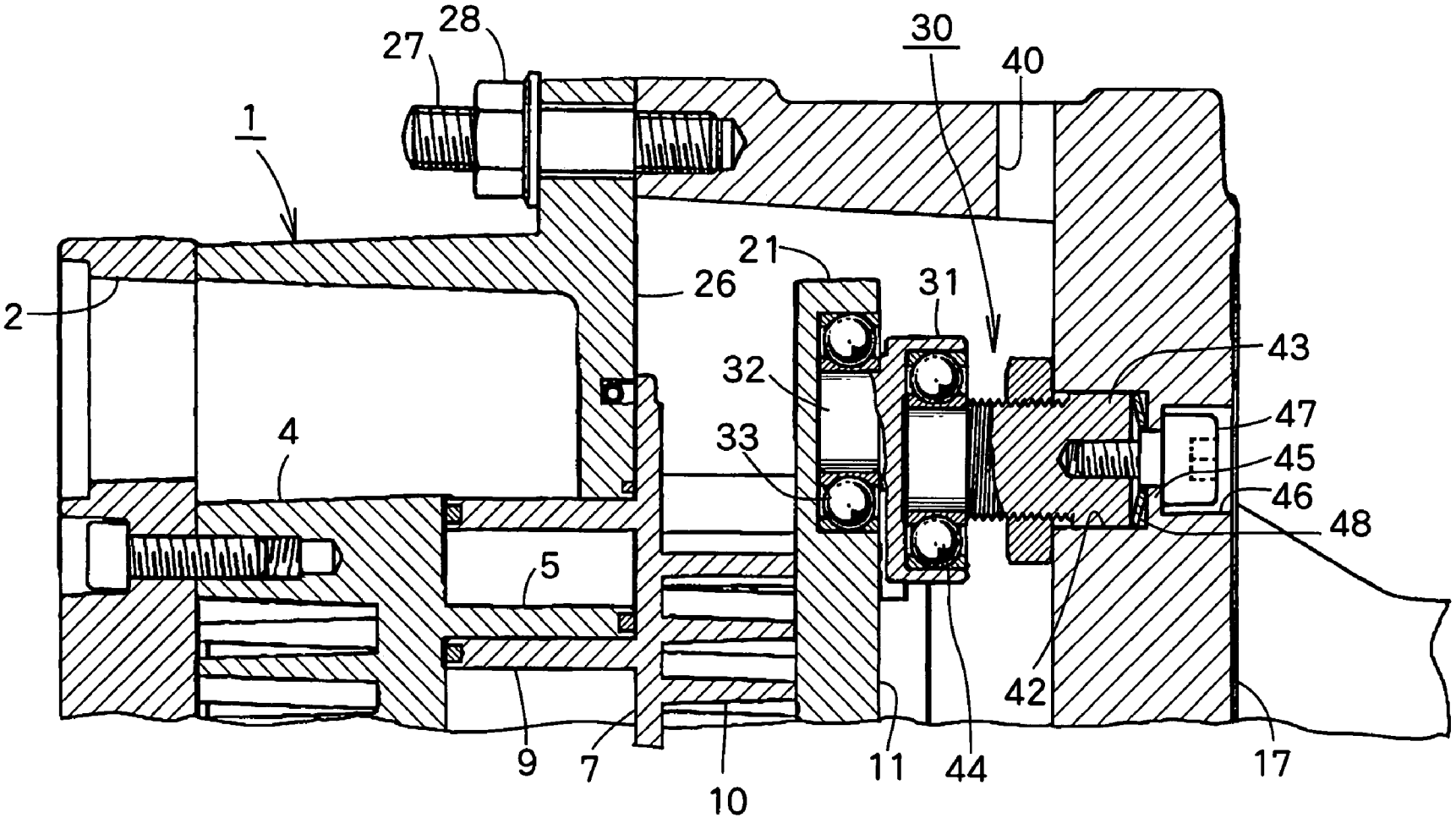
FIG. 4 is a view which shows further embodiment of the present invention and similar to FIG. 2.

FIG. 4 shows a further embodiment of the present invention, in which three eccentric bosses 21 are equally spaced on the outer circumference of a bearing plate 11. An eccentric shaft 32 which has an eccentric tube 31 is rotatably mounted via a ball bearing 33, and the inner end of a main shaft 43 which fits in a support hole 42 of a housing 17 is rotatably mounted in the eccentric tube 31 via a ball bearing 44. A smaller-diameter hole 46 is formed at the outer end of the support hole 42 via an inwardly-stepped portion 45. A clamping bolt 47 inserted into the smaller-diameter hole 46 engages in the outer end face of the main shaft 43. A belleville spring or other resilient material is put between the inner end face of the smaller-diameter hole 46 and the outer end face of the main shaft 43.

The foregoing merely relates to embodiments of the invention. Various changes and modifications may be made by a person skilled in the art without departing from the scope of claims wherein:

What is claimed is:

1. A scroll fluid machine comprising:

a housing;

a driving shaft comprising an eccentric axial portion at one end of the driving shaft;

a stationary scroll comprising a stationary wrap, the stationary scroll being fixed to the housing;

an orbiting scroll comprising an orbiting wrap and a rear surface, the orbiting scroll being positioned and configured to revolve with the eccentric axial portion of the driving shaft, the orbiting wrap being positioned and configured to engage with the stationary wrap to form a sealed chamber between the stationary wrap and the orbiting wrap;

the orbiting scroll being axially slidable for adjusting axial engagement of the orbiting scroll with respect to the stationary scroll;

a bearing plate fixed to the rear surface of the orbiting scroll and comprising an eccentric boss positioned at an outer circumference of the bearing plate, the eccentric boss having a hole; and a plurality of self-rotation preventing devices positioned on the orbiting scroll, the plurality of self-rotation preventing devices being configured to prevent the orbiting scroll from rotating on its own axis, each device of the plurality of self-rotation preventing devices comprising:

an eccentric tube connected to a main shaft rotatably fitted in the housing, an eccentric shaft comprising an inner end face, the eccentric shaft being positioned and configured to rotate eccentrically with respect to the main shaft, the eccentric shaft being engaged in the hole of the eccentric boss, a bolt screwed in the eccentric shaft of the device through the bearing plate, a nut screwed in the eccentric shaft engaging with the bearing plate, the bolt and the nut being positioned and configured to adjust engagement between the stationary scroll and the orbiting scroll, a gap between a bottom of the hole of the eccentric boss and the inner end face of the eccentric shaft, and a resilient material positioned in the gap.

2. The scroll fluid machine as claimed in claim 1, wherein the resilient material comprises a Belleville spring.

3. The scroll fluid machine as claimed in claim 1, wherein the housing includes a hole positioned and configured to allow the bolt to be operated from outside of the scroll fluid machine.

4. The scroll fluid machine as claimed in claim 1, wherein the resilient material is operable to prevent loosening of the orbiting wrap.

5. A scroll fluid machine comprising:

a housing having a support hole;

a driving shaft comprising an eccentric axial portion at one end;

a stationary scroll comprising a stationary wrap, the stationary scroll being fixed to the housing;

an orbiting scroll comprising an orbiting wrap and a rear surface, the orbiting scroll positioned and configured to revolve with the eccentric axial portion of the driving shaft thereby allowing the orbiting wrap to engage with the stationary wrap to form a sealed chamber between the stationary wrap and the orbiting wrap;

a bearing plate fixed to the rear surface of the orbiting scroll; and a plurality of self-rotation preventing devices positioned on the orbiting scroll, the plurality of self-rotation preventing devices being configured to prevent the orbiting scroll from rotating on its own axis, each device of the plurality of self-rotation preventing devices comprising:

a main shaft fitted in the housing and supported by the support hole formed in the housing and comprising a head of the main shaft, an eccentric shaft axially slidable with the main shaft, an eccentric tube connected to the eccentric shaft to allow adjustment of the engagement of the orbiting scroll with the stationary scroll, a clamping bolt screwed in the head of the main shaft, a nut screwed in the main shaft engaging with the housing, the clamping bolt and the nut being operable to control a position of the eccentric tube for adjusting the engagement, a gap between the head of the main shaft and a bottom of the support hole formed in the housing, and a resilient material positioned in the gap.

6. The scroll fluid machine as claimed 5, wherein the resilient material comprises a Belleville spring.

7. The scroll fluid machine as claimed in claim 5, wherein the resilient material is operable to prevent loosening of the orbiting wrap.

8. The scroll fluid machine as claimed in claim 5, wherein the housing includes a hole positioned and configured to allow the clamping bolt to be operated from outside of the scroll fluid machine.

* * * * *